US005333653A

United States Patent [19]

Rzesutock et al.

[11] Patent Number: 5,333,653

[45] Date of Patent: Aug. 2, 1994

[54] INFLATABLE MANHOLE SEALING DEVICE

[75] Inventors: Michael P. Rzesutock, Fayetteville; Neal A. Clevenger, Cincinnati, both of Ohio

[73] Assignee: Dover Corporation, New York, N.Y.

[21] Appl. No.: 81,563

[22] Filed: Jun. 23, 1993

[51] Int. Cl.[5] ..... B65B 1/28

[52] U.S. Cl. ..... 141/1; 141/287; 141/387; 141/383; 220/324

[58] Field of Search ..... 141/1, 287, 279, 387, 141/388, 389, 383, 386; 220/324

[56] References Cited

U.S. PATENT DOCUMENTS

| | | | |
|---|---|---|---|
| 2,832,378 | 4/1958 | Beavon | 141/287 |
| 3,176,730 | 4/1965 | Knight | 141/387 X |
| 3,190,322 | 6/1965 | Brown | 141/387 |
| 3,666,134 | 5/1972 | Rauch | 220/334 |
| 3,926,231 | 12/1975 | Madden et al. | 141/192 |
| 4,157,146 | 6/1979 | Svenson | 220/324 |
| 4,180,272 | 12/1979 | Heitz | 141/287 X |
| 4,469,152 | 9/1984 | Hardee et al. | 141/287 X |
| 5,184,654 | 2/1993 | Benzing | 141/287 |

FOREIGN PATENT DOCUMENTS

| | | | |
|---|---|---|---|
| 1287872 | 9/1972 | United Kingdom | 141/287 |
| 2053129 | 2/1981 | United Kingdom | 141/287 |

*Primary Examiner*—Ernest G. Cusick
*Attorney, Agent, or Firm*—Kinney & Schenk

[57] ABSTRACT

A manhole sealing device enables the recovery of vapors displaced from a tank during the process of filling a tank with fuel, through the manhole. The sealing device comprises a sealing gasket, which has an inflation chamber defined by two tubular walls. When the chamber is inflated, the gasket is distended to toroidal configuration capable of sealing engaging manhole inner diameters of a wide dimensional range. The sealing gasket is mounted on a lock-down bar what is clamped against the upper end of the manhole, using bolts that are also used in clamping the hatch cover for the manhole. Preferable the gasket is first inflated to centralize it relative to the manhole and then clamped in fixed relation relative thereto.

16 Claims, 5 Drawing Sheets

INFLATABLE MANHOLE SEALING DEVICE

The present invention relates, broadly, to reducing atmospheric pollution and more specifically to an improved sealing device for attaining such end, the device being particularly adapted for use in filling storage tanks through large openings, known as manholes.

The sealing device of the present invention finds particular utility in preventing atmospheric contamination in filling large, bulk transport tanks such as are found on tanker trucks and railway tank cars for the transport of liquids such as fuels, acids, alkalis and other liquid chemical products. The vapors of such products are hazardous in various fashions when they escape into the atmosphere and become airborne.

This problem of atmospheric contamination is similar to the more widely recognized problem of pollution from gasoline vapors generated in filling vehicle fuel tanks. The latter problem has been adequately overcome by vapor recovery fuel nozzles. However, there are significant differences between filling a vehicle fuel tank and filling large, bulk tanks.

In bulk transport tanks, it is a widely accepted practice to discharge liquids into the tank through a large opening in the top of the tank, such openings being commonly referenced as manholes. Conventionally the liquid is discharged into the tank by an articulated conduit system known as a loading boom. The conduits are large and of sufficient size to discharge liquids at rates of up to 50 to 100 gallons per minute or more.

There have been previous proposals for vapor recovery sealing devices adapted for use in filling such bulk transport tanks.

In one such device a plate overlays an upstanding flange, which commonly defines the manhole opening. J-hooks are then employed to engage the inner surface of the top of the tank to draw the plate into sealing engagement with the top of the flange. The device is mounted on the discharge end of a loading boom. One passage through the sealing plate permits discharge of liquid there through. Another passage provides for the flow of vapor from the tank to conduit means which extend to a remote location at which the vapors are condensed and/or otherwise safely disposed of.

Another prior proposal is similar in general function, but is provided with a conical member which sealingly engages an inner diameter surface defining the manhole opening.

These prior devices, while capable of fulfilling the basic vapor recovery function, have several shortcomings.

Primarily these shortcomings stem from the fact that there is a wide variation in the configuration of manholes from one bulk transfer tank to another.

The prior devices are limited in the range of variation in manhole configurations with which they can be used.

Another shortcoming of the prior devices is in the difficulties which can be encountered in obtaining an effective seal with the manhole opening.

The foregoing shortcomings have to some extent been overcome by a vapor recovery sealing device disclosed in U.S. Pat. No. 5,184,654 which is of common assignment with the present application. While effective in achieving the ends sought, the device of the '654 patent was relatively expensive and, for that reason, its utilization was limited.

One object of the present invention is to a sealing device that is effective in providing a seal with a wide range of manhole sizes and which is more economical than prior sealing devices having similar sealing capabilities.

Another problem not fully recognized and dealt with is that internal pressures are generated in a tank that is being loaded with fuel. If the vapor recover conduit means, to which the sealing device is connected, should become blocked, then the pressure in the tank will rise, and has the potential for becoming sufficient to rupture the tank. In most instance, should there be a blockage in the vapor recovery system, a venting valve will open to relieve the pressure in the tank and thus prevent its rupture. Such venting systems can also be provided with vapor recovery means.

Accordingly, another object of the present invention is to prevent inadvertent escape of vapors from a manhole in the event the vapor recovery system becomes blocked and so that excessive pressures in the tank may be relieved by vapor recovery venting means.

Another object of the present invention is to attain the foregoing end and at the same time provide for limited escape of vapors past the tank sealing device, as a protection against overpressurization of the tank to the extent that it will be ruptured and its contents spilled into the environment.

In accordance with one of the broader aspects of the invention, the foregoing ends are attained by a vapor recovery sealing device for use in discharging liquid into a tank through a manhole defined by a vertically disposed tubular portion.

This device comprises a generally horizontal plate. Liquid conduit means extend through the plate for the passage of liquid therethrough in filling the tank. Vapor conduit means extend through the plate for the passage of liquid vapors therethrough as such vapors are displaced from the tank as it is filled with liquid.

A sealing gasket, formed of resilient, elastomeric material, is inflatable to a toroidal configuration. This sealing gasket is mounted on a cylindrical surface, that is provided on the horizontal plate. When the sealing gasket is inflated, it exerts a uniform inward sealing force circumferentially of the mounting surface and a uniform, outward sealing force circumferentially of the inner diameter of a manhole into which the sealing device is inserted.

Preferably, the sealing gasket comprises, in its uninflated configuration, an inner tubular wall and an outer tubular wall, closely spaced from the inner wall. The upper and lower ends of the walls are interconnected to define the inflatable chamber. This provides a sealing gasket capable of sealing manholes having a wide range of inner diameters.

Other preferred features of the sealing gasket include a tubular mounting ring portion having a given height approximating the height of the mounting surface, which is provided by a tubular shell, mounted on the outer periphery of the horizontal plate. This shell has a height approximating that of the tubular mounting ring of the sealing gasket. The tubular mounting ring portion is connected to the inner tubular wall of the inflation chamber by a circumferential, neck portion of relatively small vertical height, disposed intermediate the heights of the tubular mounting ring and intermediate the height of the inner wall of the inflation chamber.

Additionally, mandrel means may be disposed in the inflation chamber. The mandrel means are adapted to facilitate return of the inflation chamber walls from their inflated, toroidal configuration to their deflated, tubular condition, In accordance with other broad aspects of the invention, other ends of the invention may be attained by a vapor recovery sealing device for use in discharging liquid into a tank through a manhole having a vertically disposed tubular portion. The upper end of the tubular portion is disposed in a horizontal plane. A hatch cover, is swingable between an open position in which the hatch cover is wholly to one side of the tubular portion and a closed position in which the hatch cover overlies and seals the tubular portion. Means, including screws mounted on the tubular portion, are provided to clamp the hatch cover in its closed position.

The sealing device comprises a generally horizontal plate. The plate has liquid conduit means which provide for the passage of liquid through the plate to filling the tank. Vapor conduit means extend through the plate for the passage of liquid vapors therethrough as such vapors are displaced from the tank as it is filled with liquid. Sealing means, mounted on the plate, are selectively actuable to sealingly engage the inner wall of the tubular portion.

Means for mounting the sealing device in fixed relation on the tubular portion comprise a lock-down bar adapted to be support by the upper end of the tubular portion, and means for suspending said horizontal plate, generally centrally, from the lock-down bar, to thereby position the sealing gasket with respect to the inner surface of the tubular portion.

The sealing device may further include means, cooperating with the hatch cover clamping screws, for locking the lock-down bar in fixed relation to the upper end of the tubular portion.

In accordance with method aspects of the invention, the gasket is first inflated to centralize the sealing device with respect to the manhole and the lock-down bar then clamped in its fixed position.

The means that cooperate with the hatch cover clamping screws may comprise a pair of slides slidingly mounted, respectively, at opposite ends of the lock-down bar. The slides having slots adapted to receive, respectively, a pair of diametrically opposed, hatch cover clamping screws, whereby nuts may be threaded onto the clamping screws to lock the lock-down bar in fixed relation to the upper end of the tubular portion.

In accordance with other method aspects of the invention, the nuts are threaded onto the clamping screws to loosely engage the slides, prior to inflation of the gasket. After inflation, the nuts are firmly threaded onto the clamping screws to rigidly secure the sealing device in place as the tank is being filled.

The above and other related objects and features of the invention will be apparent from a reading of the following description of a preferred embodiment, with reference to the accompanying drawings and the novelty thereof pointed out in the appended claims.

IN THE DRAWINGS

Figure 1:
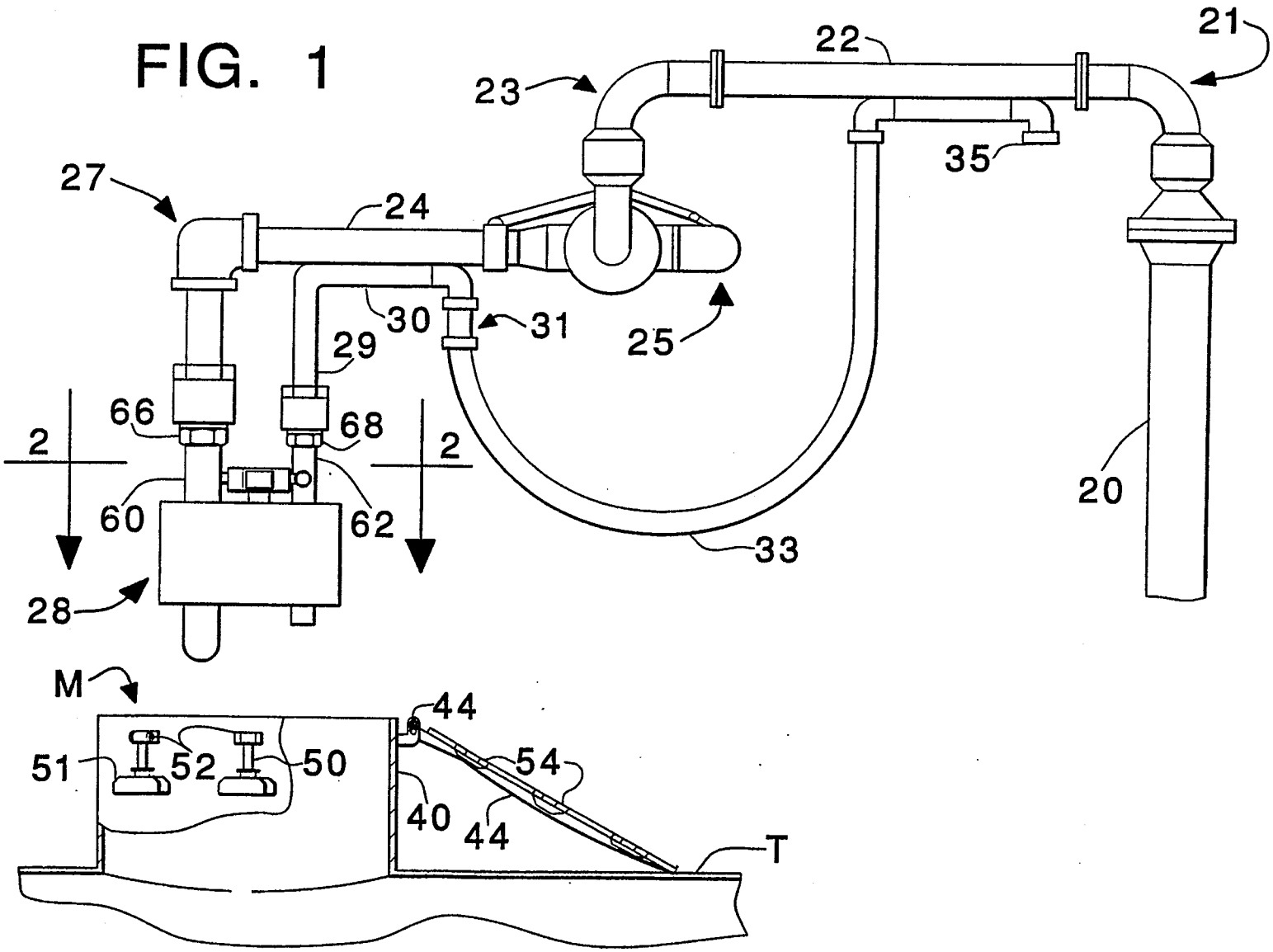
FIG. 1 is a simplified illustration of the tank sealing device of the present invention, mounted on a loading boom and positioned for insertion into a tank manhole.

FIG. 1 is a simplified illustration of a boom loading system comprising a fixed conduit 20, which is connected to a pressurized, liquid fuel source. At this point, it will be noted that the present invention is applicable to the transfer or loading of a wide variety of liquids capable of releasing vapors which would contaminate the atmosphere. These liquids include both acids and alkalis, as well as petroleum, for simplicity, reference will be made to fuel as the liquid being loaded.

Boom loading systems can take many forms. The end objective is to enable the discharge portion thereof to be readily positioned relative to a tank car manhole, where the manhole position is a variable within a given range. For illustrative purposes, there is shown a first swivel 21, a horizontal conduit 22 a second swivel 23, and a boom 24, which is provided with a spring counterbalance 25 for pivotal movement about a horizontal axis. A depending discharge conduit 26 is connected to the outer end of the boom by a swivel 27.

The sealing device of the present invention, indicated generally by reference character 28, is mounted on the lower end of the discharge conduit 26. The sealing device connects with a vapor return conduit system which comprises a vertical conduit 29, horizontal conduit 30, swivel 31, a loop of flexible conduit 33 and a connection 35 with a remote location at which vapors are safely disposed of.

In a loading operation the sealing device 28 would be manually registered with the manhole M of a tank T and then lowered and sealed with respect thereto. Briefly, this process includes locking the sealing device with respect to the manhole and then providing a pneumatic seal with respect thereto. Through the use of appropriate controls, fuel is introduced into the tank T and vapors displaced from the tank are captured and returned through the conduit and the remainder of the vapor recovery system.

When the loading operation is complete, the sealing device is unlocked from the manhole and the pneumatic sealing means are released. The sealing device is then raised clear of the manhole and is ready for another tank car to be brought to a loading position.

As a preliminary to a detailed description of the sealing device 28, further details of the referenced manhole will be given. While manhole designs vary greatly as to configuration and dimensions, a typical manhole comprises a vertically disposed tubular member 40 of circular cross section, having an inner diameter in the order of 15 to 24 inches. Except during the loading process, the manhole opening is closed by a hatch 42, which is shown in its open position in FIG. 1.

The hatch 42 is pivotally mounted on the tubular member 40 by way of a pin 44 and brackets 46, 48 projecting, respectively from the tubular member 40 and the hatch 42. The hatch is pivotal to a closed position in which it overlies the tubular member 40. A sealing gasket (not shown) may be provided between the hatch 42 and the upper end of the tubular member 40. The hatch is then clamped in this closed position by means of T-bolts 50 and nuts 51 that are pivotally mounted on lugs 52 that project outwardly from the tubular member 40. When the hatch 42 is in its closed position, the T-bolts are swung to an upwardly disposed position, between slotted lugs 54 projecting outwardly from the hatch. Nuts (not shown) on the T-bolts 50 are then threaded into engagement with the hatch lugs 54 to compress the hatch 42 into sealing engagement with the gasket between it and the tubular member, thereby providing a high pressure seal for the manhole.

As will later appear selected T-bolts 50 are employed in locking the sealing device in its operative position when fuel is being delivered into the tank T.

Figure 2:
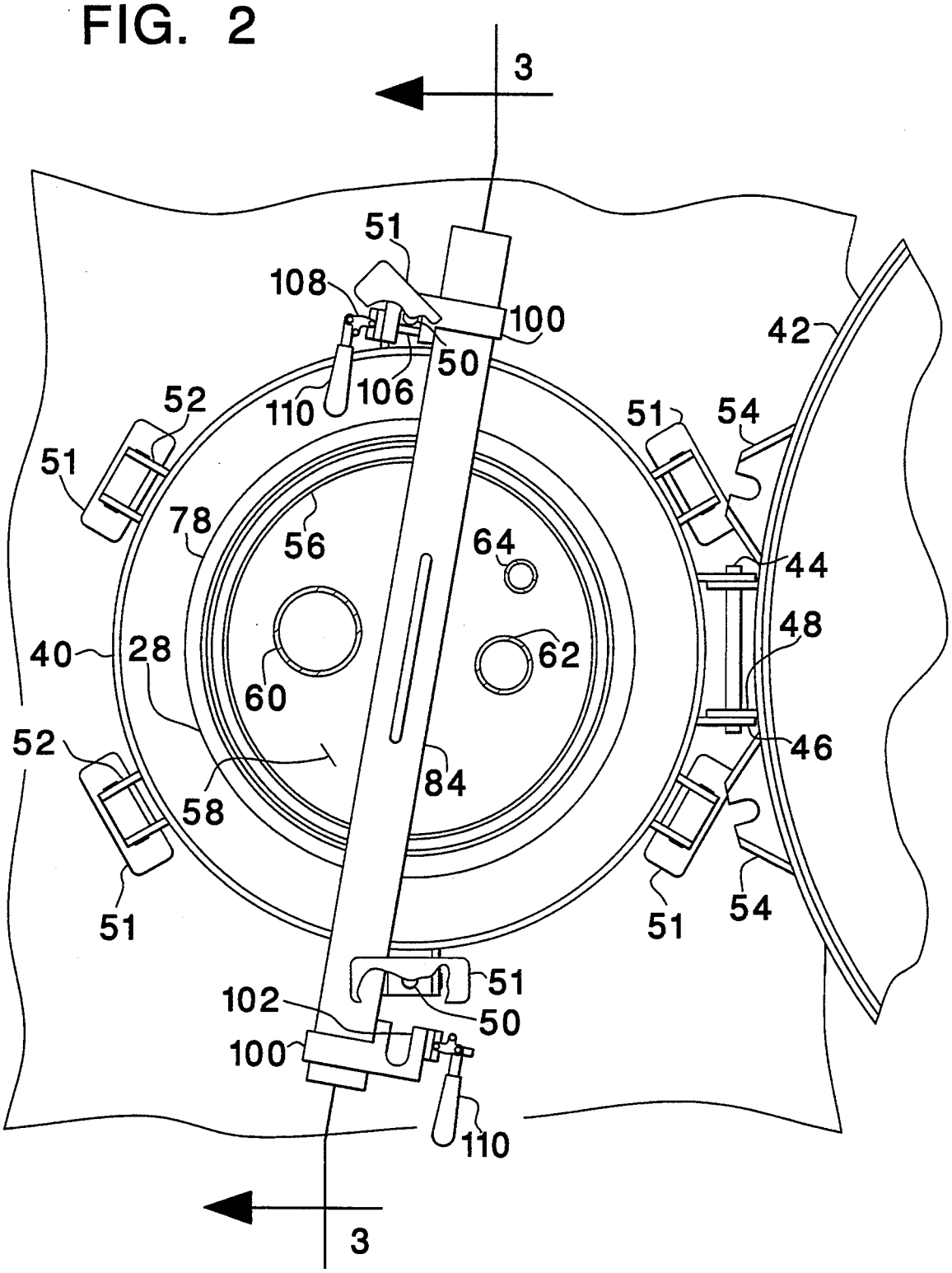
FIG. 2 is a section, on an enlarged scale, taken generally on line 2—2 in FIG. 1, with the sealing device mounted in the manhole.
Figure 3:
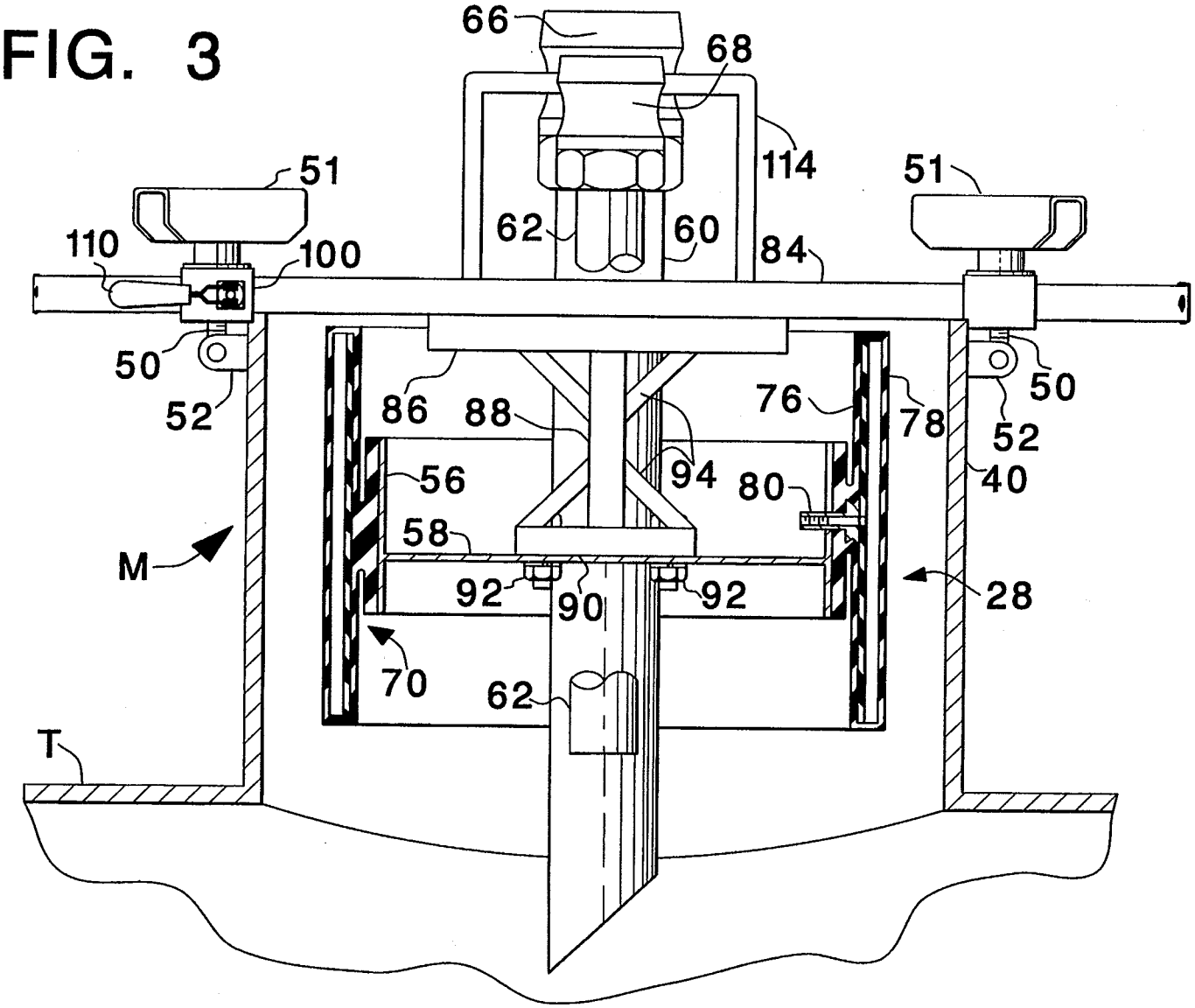
FIG. 3 is a section taken generally on line 3—3 in FIG. 2.

The sealing device 28, as shown in FIGS. 2 and 3, comprises a core assembly that includes a cylindrical, mounting shell 56 and a horizontal plate 58 that spans the inner diameter of the shell 56, intermediate its height. A fuel conduit 60, a vapor return conduit 62 and a sensor conduit 64 project through the plate 58 and provide the only means of possible fluid flow therethrough. Adapters 66, 68 are provided, respectively, at the upper ends of the conduits 60, 62. Couplers on the loading boom conduits 26, 29 may be connected to the adapters 66, 68 to mount the sealing device 28 on the loading boom.

The conduit 64 provides a passageway through the sealing device for connection to a level sensor, or other monitoring means. Appropriate seals would be provided so that vapor could not escape through the sealing device by way of this conduit.

The sealing mechanism for the present sealing device is provided by an inflatable gasket member 70. The integrally molded, components portions gasket member 70 include a relatively thick, mounting ring 72 and an inflatable chamber 74, The chamber 74 is defined by an inner, cylindrical, tubular portion 76 and an outer, cylindrical, tubular portion 78. The tubular portions 76, 78 are interconnected at their upper and lower ends. The inner, tubular portion 76 is connected to the mounting ring 72 by a circumferential neck portion 79, of reduced height, disposed centrally of the heights of the mounting ring portion 72 and the inner, tubular portion 74.

A female threaded pipe 80 is molded in place in molding the sealing gasket 70. The pipe 80 provides communication with the chamber 74 for the introduction of compressed air (or other pressurized gas) therein and the venting of same therefrom.

A mandrel 82 is disposed in the sealing gasket chamber 74. The mandrel is a cylindrical shell that extends from the top to the bottom of the chamber 74. The mandrel may be attached, as by bonding, to the pipe 80, at a hole 83 that permits air to enter the chamber 74 when it is inflated.

The sealing gasket 70 and the mandrel 82 are preferably formed of an elastomeric material that is resistant to degradation by the materials to be loaded into a tank car. For most industrial chemicals, ethylene propylene and fluorosilicone have been found to be suitable elastomers. Selection of specific materials will be within the ability of those skilled in the art.

The sealing gasket 70 is mounted on the mounting shell 56 by first aligning the pipe 80 with a vertical slot 81 formed in the shell 56. Preferably, the inner diameter of the ring portion 72 is slightly less than the outer diameter of the shell 56 so that the ring portion 72 must be expanded in being telescoped into its assembled position. The sealing ring is, thus, yieldingly held in its assembled relation.

The core assembly is mounted on a lock-down bar 84, through a top support 86, a depending post 88 and a bottom support 90, to which the plate 58 is secured by screws 92. Braces 94 provide further stability for the mounting of the core assembly on the lock-down bar 84.

In use, the sealing device 28, when mounted on the mounting, as described, is positioned above and generally centrally of the manhole M. The sealing device may then be lowered until the lock-down bar 84 rests on the upper edge of the tubular portion 40. When the sealing device 28 is so positioned, the sealing gasket 70 is properly positioned for sealing engagement with the inner surface of the manhole tubular portion 40, as particularly illustrated in FIG. 3.

At this point, the chamber 74 may be inflated with pressurized air. To this end the pipe 80 is connected by a hose 96 (shown schematically) to a source of pressurized air and a valve 98 (shown schematically) provided to control flow of pressurized air into the chamber 74, to inflate the gasket, as well as to provide means for venting the chamber 74 to deflate the gasket. It will be noted that pressurized nitrogen is frequently available at tank loading stations and may be substituted for compressed air in inflating the sealing gasket. This is to note that any pressurized, inert gaseous medium could be employed in place of air.

When pressurized air is introduced into the chamber 74, the chamber and its defining walls, including the tubular portions 76, 78 are distended from a narrow, rectangular annular configuration to a generally toroidal configuration. In doing so, the outer portion of the wall 78 is yielding and sealing engaged with the inner surface of the manhole, tubular section 40. It has been found that an effective seal can be obtained with an air inflation pressure of approximately 5 p.s.i.g.

Inflation of the sealing gasket in this fashion centers the sealing gasket 70 with respect to the manhole M and provides a pressure equilibrium wherein an equal and effective sealing pressure is provide around the full outer circumference of the sealing gasket 70.

The lock-down bar 84 is then clamped against the upper rim of the manhole 40, by means that include a pair of slides 100 that are slidably mounted on the lock-down bar 84. The slides 100 have slots 102 that receive diametrically opposed T-bolts 50. The nuts 51, are threaded downwardly on the bolts 50 to clamp the lock-down bar 84 in place on the tubular portion 40. This is to point out that the nuts 51 need never be separated from the bolts 50, but are simply tightened and then loosed in clamping either the lock-down bar 84 or the hatch cover 42.

To further detail the manner of using the present sealing device, it may first be positioned as illustrated in FIG. 1, with the slides 100 positioned at the outer ends of the lock-down bar 84. The sealing device 28 is then lowered to a position wherein the lock-down bar 84 rests on the upper rim of the tubular portion 40. The selected T-bolts 50 are swung to upright positions and the slides 100 are displaced to position the slots 102 to the bolts 50, all with the sealing device generally centralized with respect to the tubular portion 40.

Positioning of the bolts 50 in the slots 102 is facilitated by a pin 106, in each slide 100, that traps the bolt 50 in the slot 102, while permitting the lock-down bar 84 to be shifted to a desired, central position. Each pin 106 is displaced from this retaining position to a position laterally outwardly of its slot 102 by a linkage mechanism 108, of known design, that is actuated by a lever 110.

In any event, with the bolts 50 positioned in the slots 102, the nuts 51 may be threaded thereon to engage the slides 100, but not to an extent that would inhibit the lock-down bar 84 from shifting relative to the tubular portion 40. Thus, when the sealing chamber is inflated, to bring it into sealing engagement with the tubular portion 40 (FIG. 5), the sealing device is generally centered with respect to the manhole. The nuts 51 may then be tightened to firmly clamp the lock-down bar 84 in place.

The sealing device is thus in operative position for loading of fuel into the tank T, through the conduit 60. Fuel vapor, displaced from the tank T, as it is filled with fuel, passes through the conduit 62 and is returned to a disposal point through the previously described vapor recovery system.

The described sealing device, through the clamped lock-down bar 84 prevents the sealing device from being ejected from its sealing position, should there be some blockage in the vapor return system that would cause an increase in the internal pressure in the tank T. Thus, should an increase in tank pressure occur, there will not be an uncontrolled release of fuel vapor into the atmosphere from the manhole M. Instead, the overpressure condition can be relieved by venting means that are adapted to prevent release of vapor into the atmosphere. Such means do not form a part of the present invention.

It is to be noted that the effectiveness of the present sealing means is further enhanced by the initial, yielding engagement of the gasket mounting ring 72 with the mounting shell 56. The sealing effect is further enhanced in that, when the chamber 74 is inflated (FIG. 5), there is an inward sealing force effective on the shell 56, as well as an outward sealing force on the inner surface of the tubular portion 40.

Yet another advantage of the present sealing gasket is that, in the event that there would be a failure in the above referenced pressure relief, venting means, it will also serve as an emergency vent to prevent overpressurization to a degree that would cause the tank to rupture. This is to point out that, when the internal pressure in the tank reaches a pressure below that which causes the tank to rupture, the inflated gasket 70 will be deflected to create a leakage flow path between the gasket 70 and the inner surface of the tubular portion 40. While this results in an uncontrolled release of fuel vapors it is preferable to the alternate of a large scale release of the contents of the tank should overpressurization cause the tank to rupture. Again it is pointed out that release of vapors past the inflated sealing gasket 70 would only occur in the event that there was a failure in the pressure relief venting means that are normally provided for the tank.

The pressure relief aspects are a function of the inflation pressure and the hatch diameter. Higher inflation pressures resist higher tank pressures. This is basically frictional forces between the gasket wall 78 and the manhole surface with which it is engaged. It is believed that mounting of the chamber 74 on the relatively narrow neck 79 is a significant factor in providing this pressure relief function.

Figure 4:
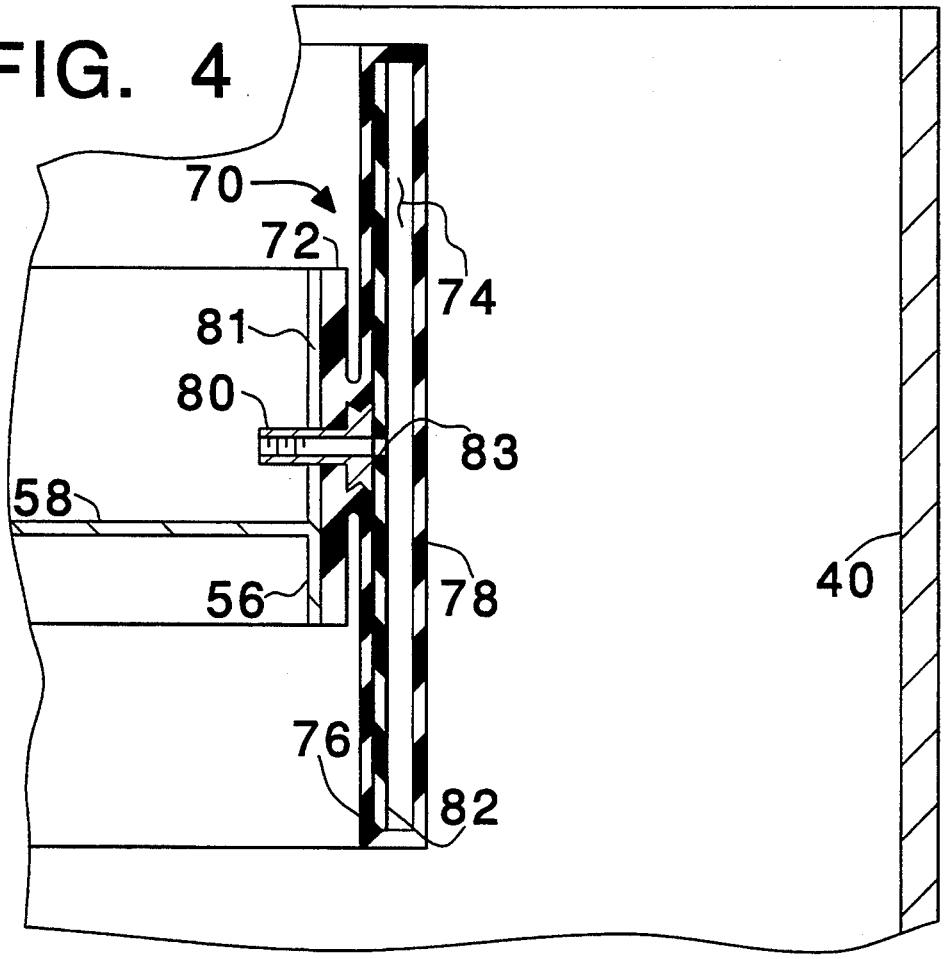
FIG. 4 is a section, on a further enlarged scale, taken on line 4–4 in FIG. 2.

After a fuel loading operation is completed, the gasket chamber 74 may be vented to atmosphere through the valve 98. When this occurs, the resilient characteristic of the elastomeric material forming the gasket portions that define the chamber 74, and particularly the tubular portions 76, 78, come into play. The gasket thus returns to its initial configuration (FIG. 4.), in which it can be readily withdrawn upwardly from the manhole M, after disengagement of the bolts 50 from the slides 100.

Elastomeric materials, after being repeatedly stressed, tend to lose their resiliency. That is, they tend to take a permanent set. If this occurs, in the sealing gasket 70, the chamber portions tend to sag, in effect increasing the outer diameter of the gasket, in its deflated condition. The mandrel 82 is disposed within the chamber 74 in order to minimize the effects of a loss in resiliency. The mandrel 82 is a tubular member which, preferably, extends through the full height of the chamber 74. When the chamber 74 is vented to atmosphere, the resiliency of the mandrel assists in returning the gasket to its original configuration and minimizes the loss in the resiliency of the gasket, or at least its effects, to the end that, upon deflation, the gasket will return to its original, minimum diameter over a long period of use.

This brings into focus a prime feature of the present invention, namely that the gasket 70 is capable of sealingly engaging manholes having inner diameters that vary over a considerable range. This end is achieved by the inflatable chamber configuration which is, initially, a double walled, tubular construction. The midpoint of the inner wall 76 is anchored on the fixed core assembly, through the neck portion 79. When the chamber 74 is inflated, the sealing portion of the gasket expands outwardly of the neck portion 79 to a toroidal configuration.

This arrangement enables the sealing device 28 to be used in loading fuel through a manhole having a diameter only slightly larger than the deflated diameter of the gasket 70, as well as through a manhole having a diameter several inches greater. A typical height of the tubular portions 76, 78 approaches 9 inches, with an outer diameter of the portion 78 being in the order of 14 inches. This gasket can be used to seal manhole openings having an opening diameter in the order of 24 inches.

Figure 5:
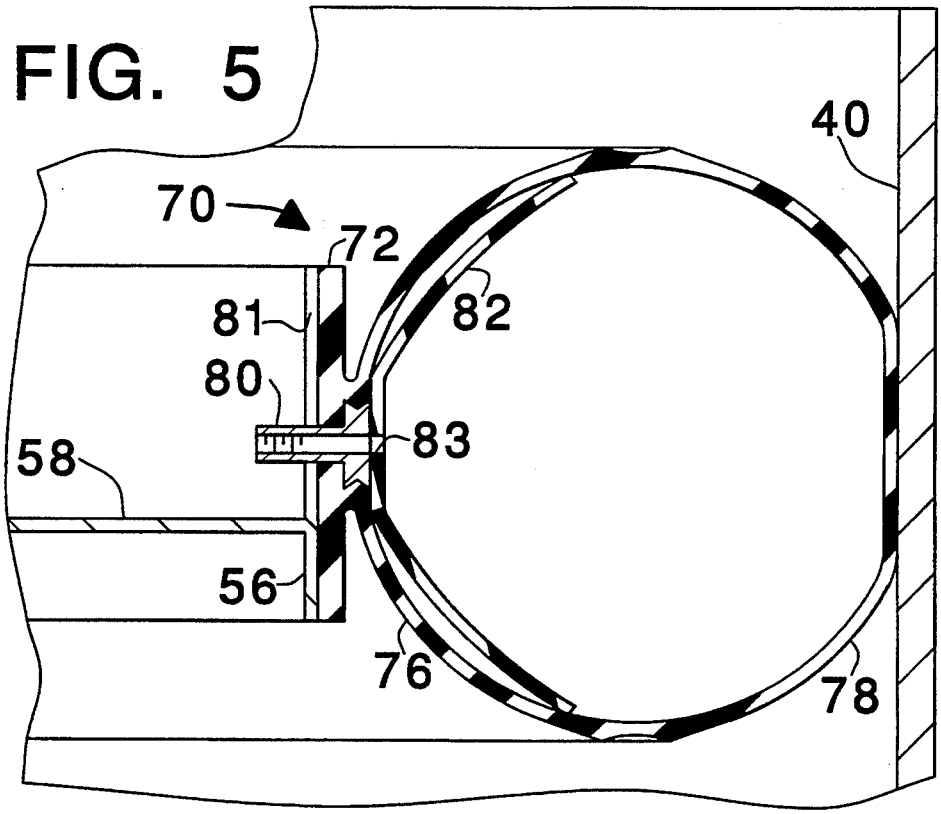
FIG. 5 is a section also on a further enlarged scale and taken on line 4–4 in FIG. 2 showing a sealing gasket inflated into a sealing relation with the manhole.
Figure 6:
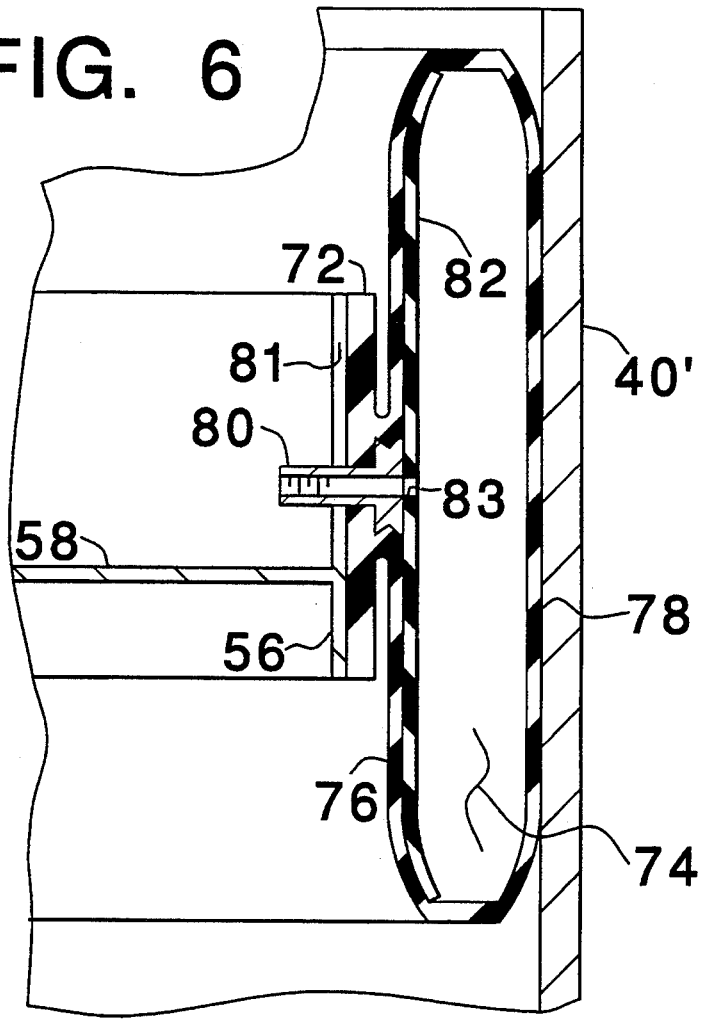
FIG. 6 is a section, similar to FIG. 5 illustrating the sealing gasket in sealing relation with a minimum diameter manhole.

FIG. 5 illustrates the sealing gasket 70 inflated to sealingly engage the tubular portion 40 that has an inner diameter approximating the maximum for which the gasket was designed. FIG. 6 illustrates the sealing gasket inflated to sealingly engage an alternate tubular portion 40' that has an inner diameter approaching the minimum diameter with which the illustrated configuration of the present device is adapted to be used.

In the foregoing description, the configuration of the gasket and more particularly the chamber 74 has been referenced as toroidal. It is to be appreciated that this configuration does not meet the strict geometric definition of a torus, namely a solid body defined by revolving a circular outline about a laterally offset, central axis. As will be appreciated from FIG. 5, there will be a "flat" on the outer portion of the gasket, where it engages the inner wall of the tubular portion 40. As will be further appreciated from FIG. 6 the cross section of the inflated chamber more closely approximates that of a thin ellipse. It is therefore to be understood that the term "toroidal" is herein used in its broadest sense to reference bodies of revolution of other than a circular outline.

It is to be appreciated that the same 5 p.s.i.g. air pressure employed in inflating the gasket, to seal the maximum diameter tubular portion 40, as above referenced, is also an effective pressurized air pressure for inflating the gasket and obtaining an effective seal with the minimum diameter tubular portion 40' illustrated in FIG. 6. Thus, no adjustments are required in adapting the sealing device 28 for use with different size manholes.

The sealing device 28 has been described in connection with its use as a permanently mounted component on a loading boom. It is to be appreciated that the device can also be deployed as a sealing unit, independent of the conduit connections thereto. This is to say the sealing device could be mounted on the manhole of a tank car, as above described. After being so mounted, a fuel supply hose could be connected to the conduit 60 and a vapor return hose connected to the conduit 64. If an overfill sensor is used, it would be mounted through the conduit 64, otherwise the conduit 64 would be sealed.

It will be seen that a handle 114 is provided centrally of the upper surface of the lock-down bar 84 to facilitate manual positioning of the sealing device 28 on a manhole.

Another advantage of the present sealing device and the sealing gasket 70, is that they are very "forgiving". This is to point out if the inner surface deviates from a true circular outline, say to an elliptical outline wherein one axis is substantially greater than the other, an effective seal will be obtained. Likewise, should the axis of the sealing device be other than coincident with that of the manhole, as above described, in either a lateral direction, or angled relative thereto, an effective seal will be obtained when the chamber 74 is inflated. These factors are to be recognized in determining what would be equivalents to the structure disclosed and claimed.

Various modifications of the illustrated embodiment of the invention will occur to those skilled in the art within the spirit and scope of the present invention, which are defined in the following claims.

Having thus described the invention, what is claimed as novel and desired to be secured by Letters Patent of the United States is:

1. A vapor recovery sealing device for use in discharging liquid into a tank through a manhole defined by a vertically disposed tubular portion, said device comprising a generally horizontal plate, liquid conduit means extending through said plate for the passage of liquid therethrough in filling said tank, vapor conduit means extending through said plate for the passage of liquid vapors therethrough as such vapors are displaced from the tank as it is filled with liquid, a sealing gasket, formed of resilient, elastomeric material, inflatable to a toroidal configuration, a cylindrical mounting surface mounted on said horizontal plate, said sealing gasket being mounted on said cylindrical surface and, when inflated, exerting a uniform inward sealing force circumferentially of said mounting surface and a uniform, outward sealing force circumferentially of the inner diameter of a manhole into which the sealing device is inserted, and wherein the sealing gasket comprises, in its uninflated configuration, an inner tubular wall, an outer tubular wall, closely spaced from the inner wall, and the upper and lower ends of said walls are interconnected to define an inflatable chamber, said outer wall, when the chamber is inflated, being displaced radially outwardly from said inner tubular wall and into circumferential sealing engagement with the inner diameter of the manhole, thereby providing a sealing gasket capable of sealing manholes having a wide range of inner diameters.

2. A vapor recovery sealing device as in claim 1, wherein the sealing gasket further comprises a tubular mounting ring portion having a given height, the mounting surface comprises a tubular shell, mounted on the outer periphery of said horizontal plate, and the tubular mounting ring portion is connected to said inner tubular wall of the inflation chamber by a circumferential, neck portion of relatively small vertical height, disposed intermediate the heights of the tubular mounting ring and intermediate the height of the inner wall of the inflation chamber.

3. A vapor recovery sealing device as in claim 2 wherein the sealing gasket includes a pipe for connection with a source of pressurized gas, said pipe extending through the neck portion and mounting ring portion of said sealing gasket and projecting inwardly of the mounting ring portion, said tubular shell has a vertical slot for receiving the inwardly projection portion of said pipe, and the inner diameter of the mounting ring portion of the sealing gasket, prior to being mounted on said shell, is less than the outer diameter of said mounting surface, whereby, the sealing gasket may be mounted on the shell by expanding the inner diameter of the mounting ring portion and then telescoping the sealing gasket downwardly of said shell, with the pipe aligned with said vertical slot, and the sealing gasket will be yieldingly gripped on said shell.

4. A Vapor recovery sealing device as in claim 1 wherein mandrel means are disposed in said inflation chamber, said mandrel means being adapted to facilitate return of the inflation chamber walls from their inflated, toroidal configuration to their deflated, tubular condition, thereby minimizing the sagging affects from a loss of resiliency in the sealing gasket material over an extended number of inflation, deflation cycles.

5. A vapor recovery sealing device as in claim 2 wherein a tubular mandrel is disposed in said inflation chamber, said mandrel having a height approximating that of the inflation chamber in its deflated configuration, said mandrel being formed of a resilient material and adapted to facilitate return of the inflation walls from their inflated, toroidal configuration to their deflated, tubular condition, thereby minimizing the sagging affects from a loss of resiliency in the sealing gasket material over an extended number of inflation, deflation cycles.

6. A vapor recovery sealing device as in claim 3, wherein the sealing device is adapted to seal a manhole having the upper end of its tubular portion disposed in a horizontal plane, a hatch cover swingable between an open position in which the hatch cover is wholly to one side of the tubular portion and a closed position in which the hatch cover overlies and seals the tubular portion, and means, including screws mounted on said tubular portion, for clamping the hatch cover in its closed position, said sealing device further including a lock-down bar adapted to be supported by the upper end of the tubular portion, and means for suspending said horizontal plate, generally centrally from said lock-down bar, to thereby position said sealing gasket with respect to the inner surface of said tubular portion.

7. A vapor recovery sealing device as in claim 6 wherein the sealing device further includes means, cooperating with hatch cover clamping screws, for locking the lock-down bar in fixed relation to the upper end of the tubular portion.

8. A vapor recovery sealing device for use in discharging liquid into a tank through a manhole having a vertically disposed tubular portion, the upper end of the tubular portion disposed in a horizontal plane, a hatch cover swingable between an open position in which the hatch cover is wholly to one side of the tubular portion and a closed position in which the hatch cover overlies and seals the tubular portion, and means, including screws mounted on said tubular portion, for clamping the hatch cover in its closed position, said device comprising a generally horizontal plate, liquid conduit means extending through said plate for the passage of liquid therethrough in filling said tank, vapor conduit means extending through said plate for the passage of liquid vapors therethrough as such vapors are displaced from the tank as it is filled with liquid, sealing means mounted on said plate and selectively actuable to sealingly engage the inner wall of said tubular portion, and means for mounting said sealing device in fixed relation on said tubular portion, said mounting means comprising a lock-down bar adapted to be support by the upper end of the tubular portion, and means for suspending said horizontal plate, generally centrally from said lock-down bar, to thereby position said sealing gasket with respect to the inner surface of said tubular portion.

9. A vapor recovery sealing device as in claim 8, wherein the sealing device further includes means, cooperating with hatch cover clamping screws, for locking the lock-down bar in fixed relation to the upper end of the tubular portion.

10. A vapor recovery sealing device as in claim 9, wherein the means cooperating with the hatch cover clamping screws comprise a pair of slides slidingly mounted, respectively, at opposite ends of the lock-down bar, said slides having slots adapted to receive, respectively, a pair of diametrically opposed, hatch cover clamping screws, whereby a nuts may be threaded onto said clamping screws to lock the lock-down bar in fixed relation to the upper end of the tubular portion.

11. A vapor recovery sealing device as in claim 10 wherein the sealing device further includes selectively actuable means for maintaining said clamping screws in said slots, prior to the nuts threaded thereon being tightened to a clamping position, whereby the sealing device may be shifted to a desired, position centrally of said manhole, prior to the lock-down bar being clamped.

12. A method of installing a vapor recovery sealing device in a manhole in a tank into which liquid is to be discharged, wherein the manhole has a vertically disposed tubular portion, the upper end of the tubular portion disposed in a horizontal plane, a hatch cover swingable between an open position in which the hatch cover is wholly to one side of the tubular portion and a closed position in which the hatch cover overlies and seals the tubular portion, and means, including screws mounted on said tubular portion, for clamping the hatch cover in its closed position, and wherein said device comprises a generally horizontal plate, liquid conduit means extending through said plate for the passage of liquid therethrough in filling said tank, vapor conduit means extending through said plate for the passage of liquid vapors therethrough as such vapors are displaced from the tank as it is filled with liquid, sealing means mounted on said plate and selectively actuable to sealingly engage the inner wall of said tubular portion, a lock-down bar adapted to be support by the upper end of the tubular portion, and means for suspending said horizontal plate, generally centrally from said lock-down bar, said method comprising the steps of positioning the lock-down bar so that it is supported by the upper end of the tubular portion, with the sealing means disposed below the upper end of the tubular portion and engageable with the inner diameter of the tubular portion, inflating the gasket means to sealing engage the inner diameter of the tubular portion and thereby, under a condition of pressure equilibrium, centering the sealing device with respect to the manhole, and thereafter clamping the lock-down bar with respect to the upper end of the tubular portion, to thereby provide a sealing of the manhole opening that is resistant to displacement by forces generated internally of the tank.

13. A method of installing a vapor recovery sealing device as in claim 12, including the further step of employing the hatch cover clamping screws in clamping the lock-down bar in fixed relation relative to the upper end of the tubular portion.

14. A method of installing a vapor recovery sealing device as in claim 13 wherein the sealing device further includes a pair of slides slidingly mounted, respectively, at opposite ends of the lock-down bar, and each slide having a horizontally extending slot adapted to receive one of the hatch cover clamping screws, and further wherein the lock-down bar is positioned to rest on the upper edge of the tubular portion, with the slides disposed, at opposite ends of the lock-down bar, outwardly of the tubular portion, and including the further steps of adjusting the slides and said clamping screws so that the slots in the respective slides receive diametrically opposed clamping screws and then performing the inflating step.

15. A method of installing a vapor recovery sealing device as in claim 14 wherein the hatch cover clamping screws are pivotally mounted on the exterior surface of the tubular portion, and the sealing device comprises, on each slide, a pin slidable from a position outside the slot therein to a position closing off the inner end of said slot, and further including the steps of positioning the diametrically opposed clamping screws in upright positions to enable them to be, respectively, received in the slots in the slides, and displacing each of said slide pins to a position in which the clamping screw is captured in the inner end of the slot.

16. A method of installing a vapor recovery sealing device as in claim 15 further including the step of threading the nuts onto the clamping screw to an extent that substantial upward movement of the lock-down bar is prevented, prior to inflating the sealing gasket, and after inflating the sealing gasket, threading the nuts to tightly clamp the lock-down bar against the upper end of the tubular portion.

* * * * *